US010124360B2

(12) United States Patent
Clay et al.

(10) Patent No.: US 10,124,360 B2
(45) **Date of Patent: *Nov. 13, 2018**

(54) IRRIGATION

(71) Applicant: RX Plastics Limited, Ashburton (NZ)

(72) Inventors: Chris Clay, Ashburton (NZ); Kerry John Turner, Timaru (NZ)

(73) Assignee: RX PLASTICS LIMITED, Ashburton (NZ)

( * ) Notice: Subject to any disclaimer, the term of this patent is extended or adjusted under 35 U.S.C. 154(b) by 0 days.

This patent is subject to a terminal disclaimer.

(21) Appl. No.: 13/834,089

(22) Filed: Mar. 15, 2013

(65) Prior Publication Data

US 2014/0117115 A1 May 1, 2014

(30) Foreign Application Priority Data

Oct. 30, 2012 (NZ) ..... 603312

(51) Int. Cl.

| | |
|---|---|
| ***B05B 15/16*** | (2018.01) |
| ***B05B 15/00*** | (2018.01) |
| ***B05B 15/622*** | (2018.01) |
| *B05B 15/70* | (2018.01) |
| *B05B 15/74* | (2018.01) |

(52) U.S. Cl.

CPC ..... *B05B 15/001* (2013.01); *B05B 15/16* (2018.02); *B05B 15/622* (2018.02); *B05B 15/70* (2018.02); *B05B 15/74* (2018.02)

(58) Field of Classification Search

CPC ... B05B 15/062; B05B 15/064; B05B 15/001; B05B 15/10; B05B 15/061; B05B 15/62; B05B 15/622; B05B 15/625; B05B 15/16; B05B 15/14; B05B 15/70; B05B 15/74; A01G 25/00

USPC ..... 239/200, 201, 203, 288, 288.5, 288.3, 239/273–279; 47/20.1, 21.1

See application file for complete search history.

(56) References Cited

U.S. PATENT DOCUMENTS

| | | | | |
|---|---|---|---|---|
| 4,212,426 | A * | 7/1980 | Choi | 239/230 |
| 5,772,118 | A * | 6/1998 | Fabiano | B05B 15/001 239/276 |
| 5,938,121 | A * | 8/1999 | Ferguson et al. | 239/203 |
| 6,764,025 | B1 * | 7/2004 | Espina | 239/288 |
| 7,114,665 | B1 * | 10/2006 | Mc Tee | 239/288 |
| 7,717,360 | B1 * | 5/2010 | Kander | 239/208 |
| 2005/0011970 | A1 * | 1/2005 | Fernandez | B05B 15/10 239/205 |
| 2005/0284956 | A1 * | 12/2005 | Mast | 239/288 |
| 2007/0095936 | A1 * | 5/2007 | Ungerecht | 239/288.3 |

* cited by examiner

*Primary Examiner* — Steven J Ganey
*Assistant Examiner* — Juan C Barrera
(74) *Attorney, Agent, or Firm* — Greer, Burns & Crain, Ltd.

(57) ABSTRACT

A shroud for an in-ground sprinkler assembly is provided including an above ground and a below ground portion, wherein the height of the above ground portion is at least substantially 150 mm above the surface of the ground.

4 Claims, 4 Drawing Sheets

IRRIGATION

TECHNICAL FIELD

The present invention relates to improvements in and relating to irrigation.

BACKGROUND

At present irrigation systems can be broadly classified into two classes fixed in ground systems (often referred to as solid set systems) and mobile above ground systems.

In general solid set systems are used for horticultural applications, particularly for irrigating very large areas of land, and mobile systems are used for animal farming applications usually for smaller areas of land to minimise set up time. Solid set systems comprise a riser pipe which extends from an in ground supply line and upon which a sprinkler head is located; and mobile systems comprise a string of sprinkler units on skids or pods which are joined by an above ground supply line A key reason for solid set systems being used in horticulture is that larger animals, such as cattle and pigs, can cause extensive damage to sprinklers left in situ due to the animals' size, weight and frequently curiosity of the animal.

To combat these problems mobile sprinkler systems have been developed to b e used predominantly when a field does not have animals grazing thereon and the sprinklers are simply swapped to a new field as the animals are rotated between fields or they are large enough for the animals not to interfere with them. Some mobile sprinkler systems such as the applicants very successful K-LINE™ sprinklers have a protective pod which surrounds the sprinkler to protect the sprinkler from animals should the sprinklers and animals share a field for a period of time as well as protect the sprinklers from damage when being moved between fields.

However, when grazing large herds on large fields mobile systems suffer from a number of drawbacks including:

- Time and labour involved with moving the sprinkler line(s) within a field and/or between fields;
- Ensuring proper placement of the pods each time the mobile system is set up to ensure proper coverage of the field with liquid from the sprinkler head occurs.

It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

SUMMARY

According to one aspect of the present invention there is provided an in-ground shrouded sprinkler assembly wherein:

- a sprinkler assembly which includes an upright riser on which a sprinkler head is mounted;
- a shroud which includes one or more walls with an opening at the top thereof, wherein the wall(s) substantially surround a sprinkler assembly, but wherein said wall(s) do not surround said sprinkler head in a manner which will, in use, interfere with delivery of liquid via sprinkler head; and wherein
- the shroud is configured to include:
  - an above ground portion; and
  - a below ground engaging portion;

wherein the shroud also includes an animal guard which covers the opening and protects the sprinkler assembly.

According to one aspect of the present invention there is provided an in-ground shrouded sprinkler assembly substantially as described above wherein the assembly includes a control valve.

According to one aspect of the present invention there is provided an in-ground shrouded sprinkler assembly substantially as described above wherein the ground engaging portion includes at least one anti-rotation portion.

According to one aspect of the present invention there is provided an in-ground shrouded sprinkler assembly substantially as described above wherein the ground engaging portion includes at least one height management feature.

According to one aspect of the present invention there is provided an in-ground shrouded sprinkler assembly substantially as described above wherein the shroud includes at least one positioning element to maintain the upright riser in a substantially vertical orientation.

According to one aspect of the present invention there is provided an in-ground shrouded sprinkler assembly substantially as described above wherein the top edge of the wall(s) is rounded to minimise cattle rub damage.

According to a further aspect of the present invention there is provided a shroud configured to include:

- one or more walls with an opening at the top thereof, wherein the wall(s) can, in use, substantially surround a sprinkler assembly, but wherein said wall(s) do not surround said sprinkler head in a manner which will, in use, interfere with delivery of liquid via sprinkler head; and wherein
- the shroud is configured to include:
  - an above ground portion; and
  - a below ground engaging portion.

wherein the shroud also includes an animal guard which covers the opening and protects the sprinkler assembly.

According to a further aspect of the present invention there is provided a shroud substantially as described above wherein the ground engaging portion includes at least one anti-rotation portion.

According to a further aspect of the present invention there is provided a shroud substantially as described above wherein the ground engaging portion includes at least one height management feature.

According to a further aspect of the present invention there is provided a shroud substantially as described above wherein the shroud includes at least one positioning element to maintain the upright riser in a substantially vertical orientation.

According to a further aspect of the present invention there is provided a shroud substantially as described above wherein the top edge of the wall(s) is/are rounded to minimise cattle rub damage.

According to a further aspect of the present invention there is provided an elongate shroud which includes one or more walls with an opening at the top thereof, wherein the wall(s) in use, can substantially surround a sprinkler assembly, and where the shroud is configured to include:

an above ground portion; and a below ground portion;

wherein the wall(s) do not surround the sprinkler assembly in a manner which will interfere with normal operation of the sprinkler, wherein the height of the above ground portion and below ground portion are substantially the same.

According to a further aspect of the present invention there is provided a method of protecting an in-ground sprinkler assembly comprising the steps of using a shroud including:

an above ground portion; and a below ground portion;

to surround said sprinkler assembly, wherein the wall(s) do not surround the sprinkler assembly in a manner which will interfere with normal operation of the sprinkler, wherein the height of the above ground portion and below ground portion are substantially the same.

According to a further aspect of the present invention there is provided a method of protecting an in-ground sprinkler assembly comprising the steps of using a shroud including:

an above ground portion; and a below ground engaging portion;

to surround said sprinkler assembly, wherein the relative contribution that the length of the above ground portion and the below ground engaging portion, respectively make to the overall length of the shroud, whilst unequal, is such that: if the relative lengths of the above ground portion and the below ground portion were to be swapped, the shroud could still effectively function as an in-ground sprinkler assembly protector.

According to a further aspect of the present invention there is provided an elongate shroud including:

an above ground portion; and a below ground engaging portion;

wherein the relative contribution that the length of the above ground portion and the below ground engaging portion, respectively make to the overall length of the shroud, whilst unequal, is such that: if the relative lengths of the above ground portion and the below ground portion were to be swapped, the shroud could still effectively function as an in-ground sprinkler assembly protector.

The term "effectively function" as used herein refers to the ability of the shroud to maintain a substantially upright position when in use, without becoming knocked over by nearby animals grazing in the vicinity of the shroud.

According to a further aspect of the present invention there is provided an irrigation system which includes at least one in-ground shrouded sprinkler assembly substantially as described above.

According to another aspect of the present invention there is provided a shroud for an in-ground sprinkler assembly including an above ground and a below ground portion wherein the height of the above ground portion is at least substantially 150 mm above the surface of the ground.

In one embodiment the height of the above ground portion may be at least substantially 300 mm.

It would be understood by a person skilled in the art that for a grazing animal such as sheep, the height of the above ground portion may be substantially 150 mm, and for a grazing animal such as cattle may be substantially 300 mm.

According to a further aspect there is provided a shroud for an in-ground sprinkler assembly including an above ground and a below ground portion wherein the height of the above ground portion is sufficiently high that a grazing animal will not step into the shroud and yet is sufficiently low that a grazing animal will not use the shroud to rub against its body.

The grazing animal may be any animal one wants to farm.

According to a still further aspect there is provided a shroud as described above wherein the below ground portion is sufficiently deep to prevent the shroud being knocked over by the animal or by the force of the water jet leaving the sprinkler.

BRIEF DESCRIPTION OF THE DRAWINGS

Further aspects of the present invention will become apparent from the ensuing description which is given by way of example only and with reference to the accompanying drawings in which.

DETAILED DESCRIPTION

Figure 1:
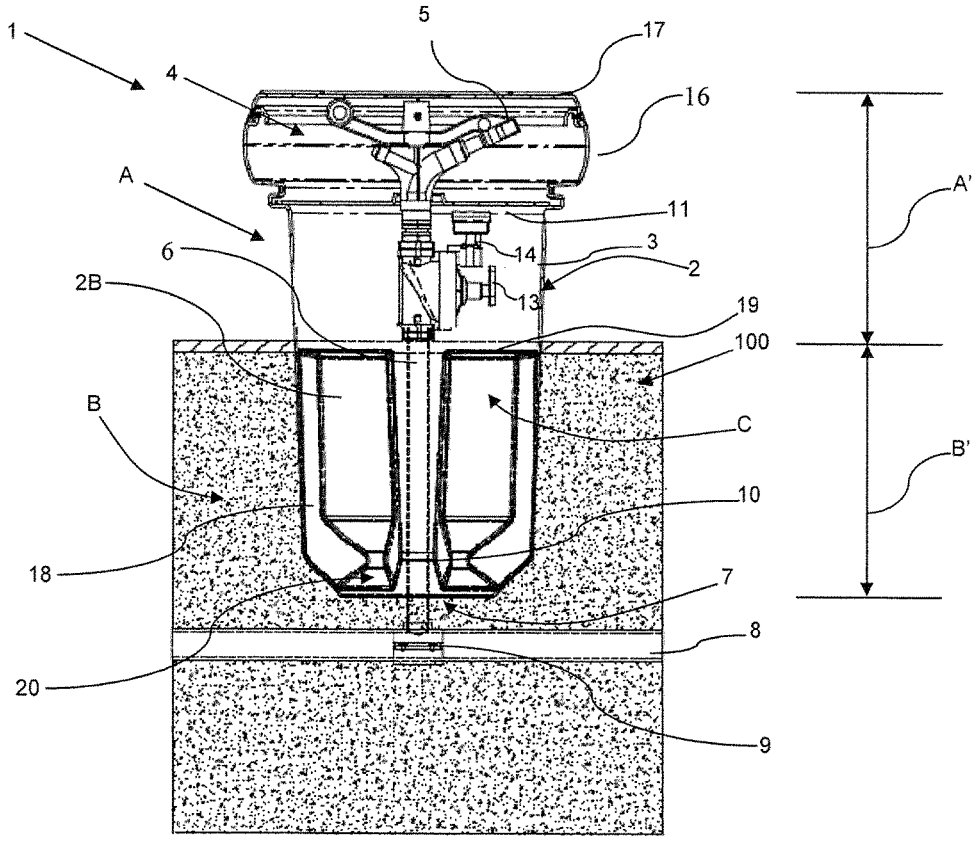
FIG. 1 shows a side view of one preferred embodiment of the present invention.
Figure 2:
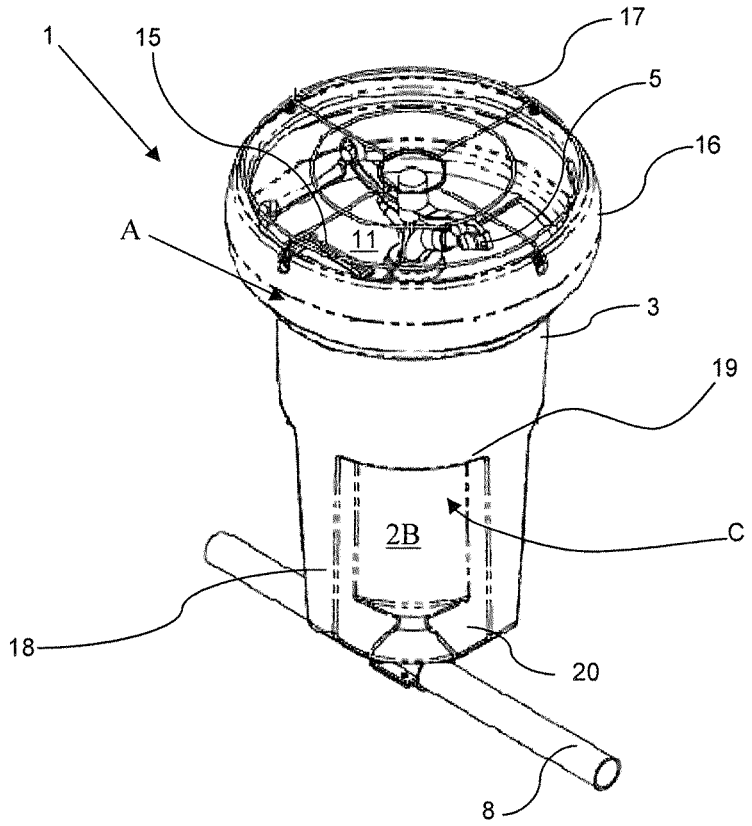
FIG. 2 shows a perspective view of the embodiment shown in FIG. 1.
Figure 3:
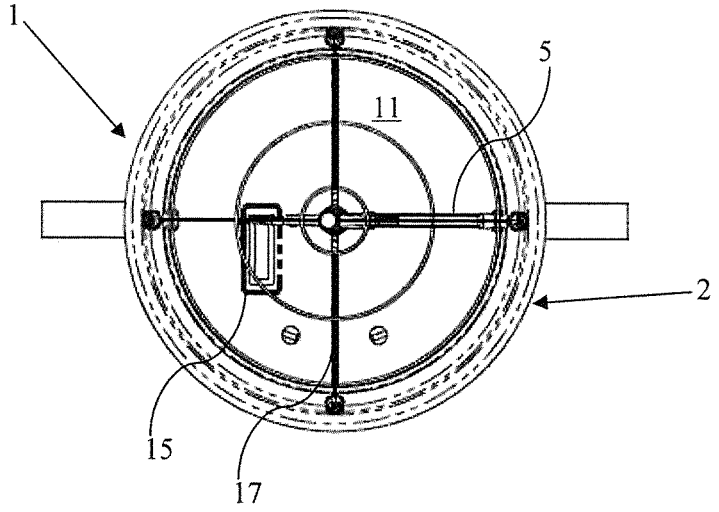
FIG. 3 shows a top plan view.

With respect to the figures, there is shown an in-ground shrouded (IGS) sprinkler assembly 1 which is located in the ground 100. The IGS sprinkler assembly 1 has a substantially cylindrical shroud 2 made of plastic having a substantially cylindrical wall 3 which surrounds a sprinkler assembly generally indicated by arrow 4. The sprinkler assembly has a sprinkler head 5 mounted upon an upright riser in the form of pipe 6.

The pipe 6 passes out the bottom of the shroud via aperture 7 and is connected to a water supply line 8 via a saddle clamp 9. Pipe 6 is held firmly in a vertical orientation via a lower positioning element in the form of a collar 10, and an upper positioning element in the form of a cover 11 having a central aperture (not shown), through both of which the pipe 6 passes and abuts. The top of the pipe 6 has a solenoid actuated diaphragm valve 13 attached thereto. Connected to the valve 13 is a solenoid timer 14 which has power supplied thereto by a solar panel 15. Connected to the top of pipe 6 via the valve 13 is a sprinkler head 5.

The top of the shroud 2 has a rounded lip 16 which has connected to the top thereof an animal guard 17 made of stainless steel.

The shroud has an above ground portion A and a below ground portion B. Below ground portion B has four effectively radially extending protrusions 18 which extend out from a narrower diameter shroud wall (2B) relative to the cylindrical wall 3 of the above ground portion A. The shroud 2 also has a height management feature in the form of a line 19 which marks the boundary of the above ground and below ground engaging portions. The line 19 is created by the reduction in the diameter of the wall 3 by way of an indent C for the lower ground portion B. The ground engaging portion B of the shroud 2 also has a bottom lip 20 on which a body of soil or other substrate can sit to help prevent the shroud from easily being pulled from the ground.

In use the present invention can be installed by mole ploughing a 63 mm LD or MD irrigation ring supply main directly into the ground. This feeds water off the mainline supply. At the calculated intervals along the ring holes will be dug and the fixed shroud and sprinkler arrangement will be tapped in using a saddle arrangement.

As the shroud is held above the ring main by the soil and not in direct contact, the pipe can be mole ploughed at variable depth.

In one preferred embodiment there are 14 individual pods on a single ring main. However there is not enough flow to sustain 14 sprinklers on a single 63 mm line. Therefore individual sprinklers are switched on or off using either timers or centralised control systems. At any single instant the number of sprinklers going is matched to the capacity that can be delivered by the 63 mm ring main and system.

Figure 4:
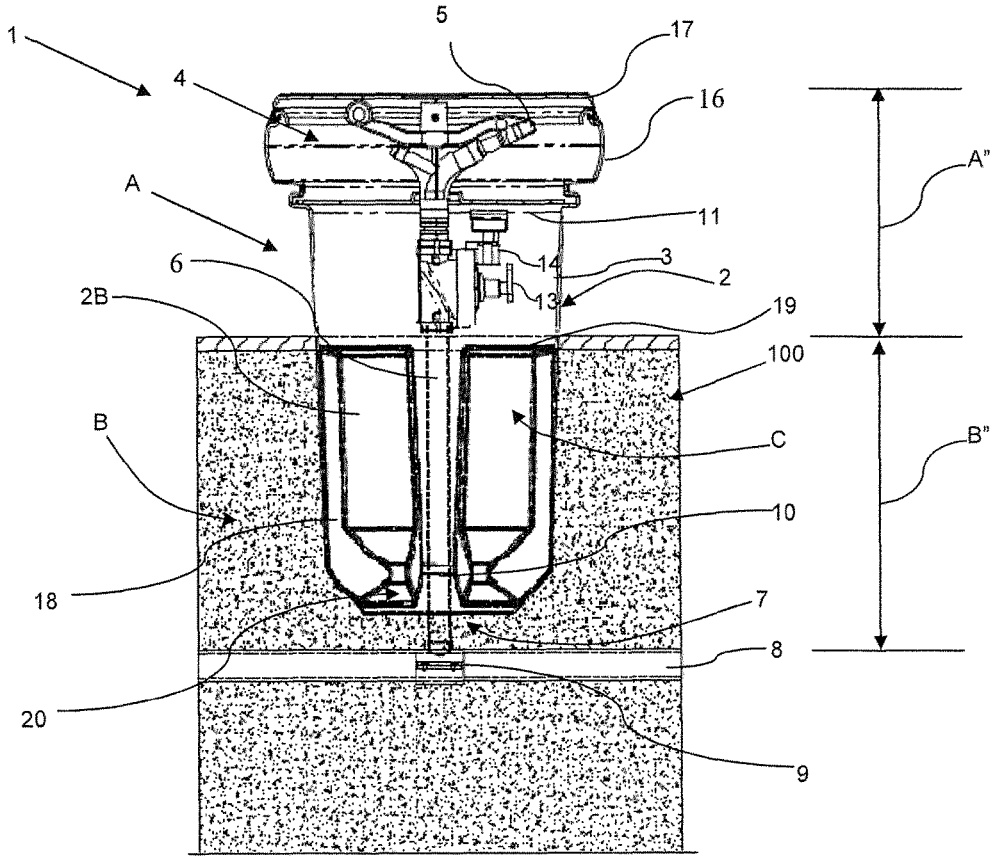
FIG. 4 shows a side view of an alternate preferred embodiment of the present invention.

The in-ground shrouded (IGS) sprinkler assembly shown in FIG. 4 is essentially identical to that shown in FIG. 1 with one difference. For this reason like reference numerals to FIG. 1 refer to like features in FIG. 4.

The difference between the IGS sprinkler assemblies in FIGS. 1 and 4 is the relative length of the above ground portion A and the below ground engaging portion B as depicted by:

- line A' and B' for FIG. 1 which are substantially the same length; and
- line A" and B" for FIG. 4 wherein the length of above ground portion A shown by line A" is shorter than that of the below ground engaging portion B shown in line B". Importantly, it can be seen that the differential in length between the length of the above ground and the below ground portions is not so great as to prevent fully functioning IGS sprinkler assembly which has length B" being the length of the above ground portion A and length A" being the length of the below ground engaging portion B.

DETAILED DISCUSSION OF ALTERNATE WAYS TO IMPLEMENT THE INVENTION

Substantially surround when viewed from plan view. i.e, so top part of sprinkler can protrude above said walls.

The upright riser may be any suitably configured conduit to which is optionally connected to a pressurised water supply at one end thereof and a sprinkler head at the other. The upright riser positions the sprinkler head within the shroud so that water stream exiting the head impinges on said shroud.

The upright riser is optionally integrally formed as part of the shroud.

Alternatively the upright riser may be a separate pipe.

The upright riser is optionally directly or indirectly connected to a water supply line via a clamping device which secures a connection between the water supply line and the upright riser.

The sprinkler head may be a self rotating sprinkler head in some embodiments.

In alternate embodiments, the sprinkler head may be a nozzle.

The shroud optionally has a variety of different shapes and configurations without departing from the scope of the present invention.

In one embodiment, the shroud may have substantially cylindrical body with an integrally formed base portion and open top end. In such an embodiment, there is optionally provided at least one aperture in or substantially adjacent the base which facilitates connection to a water supply line.

In an alternate embodiment, the shroud has four walls and a base member.

The shroud has an internal space between the wall(s) which is dimensioned to house and allow for:

- any operational movement of the sprinkler head; and/or
- a clear exit path for a jet or stream of liquid from the sprinkler head.

The shroud is optionally integrally formed. In some embodiments, the shroud may be formed by roto-moulding or other suitable moulding or casting technique.

The height of the wall(s) and height of the upright riser are both such as to enable liquid to be delivered from the sprinkler head without impinging on the wall(s) of the shroud. Additionally, the dimensions of the opening at the top of the shroud also enable liquid to be delivered from the sprinkler head without impinging on the wall(s) of the shroud.

The above ground portion of the shroud preferably has a smooth exterior surface.

The above ground portion of the shroud is optionally cylindrical in shape.

The ground engaging portion is optionally provided in a variety of different forms without departing from the scope of the present invention.

In one embodiment, the ground engaging portion includes at least one effectively radially extending protrusion which helps prevent rotation of the shroud once located in the ground. In some embodiments, there may be three or four radially extending protrusions.

In further embodiments, the ground engaging protrusion includes a bottom lip which retains a layer of soil thereon to help prevent easy removal of the shroud from the ground.

In another embodiment, the ground engaging portion includes a height management feature in the form of a line indicating the level to which the ground engaging portion is to be buried in the ground.

In one embodiment, the above ground and ground engaging portions both include one positioning element which collectively holds the upright riser in a substantially vertical orientation.

The animal guard is optionally provided in a variety of different forms.

In one embodiment, the animal guard is in the form of a lattice or lattice like structure.

In another embodiment, the animal guard is in the form of a shield.

It is envisaged that the timer control valve is provided in a variety of different forms without departing from the scope of the present invention.

In one embodiment, the control valve includes or is associated with a timer or other control system such as a PLU.

In one embodiment, the control valve includes a solenoid actuated diaphragm valve and associated timer together with an associated power supply.

The power supply may come from a power line.

In one embodiment, the power supply comes from a solar cell.

In an alternate embodiment, the power supply comes from a battery or battery pack.

Aspects of the present invention have been described by way of example only, and it should be appreciated that modifications and additions may be made thereto without departing from the scope thereof as defined in the appended claims.

The claims are as follows:

1. A solid set non-pop-up in-ground sprinkler system comprising: a shroud surrounding a non-pop up sprinkler, said shroud having an above ground portion and a below ground portion, wherein a height management feature is provided that marks a boundary between the above ground and the below ground portion and which indicates the portion of the shroud which, in use, need to be positioned below a ground surface to provide stability to the portion of the shroud that is positioned above the ground surface, wherein the height of the above ground portion is at least substantially 150 mm above the ground surface and wherein the depth of the below ground portion is at least substantially 150 mm;

and an animal guard attached to said shroud, a portion of said animal guard extending across a top of the shroud and over the sprinkler.

2. The solid set non-pop-up in-ground sprinkler system as claimed in claim 1, wherein the shroud is at least substantially 300 mm above the ground surface and wherein the depth of the below ground portion is at least substantially 300 mm.

3. The solid set non-pop-up in-ground sprinkler system as claimed in claim 1, wherein said above ground portion of said shroud includes a lip extending outwardly from said shroud, and said animal guard is attached to a top of said lip.

4. The solid set non-pop-up in-ground sprinkler system as claimed in claim 1, wherein said animal guard has a lattice structure.

* * * * *